US005313732A

United States Patent [19]

Peifer

[11] Patent Number: 5,313,732

[45] Date of Patent: May 24, 1994

[54] MUZZLE LOADING RIFLES

[76] Inventor: Ralph D. Peifer, R.R. 2, Box 155-A, Nokomis, Ill. 62075

[21] Appl. No.: 995,140

[22] Filed: Dec. 22, 1992

[51] Int. Cl.[5] ..... F41A 19/00

[52] U.S. Cl. ..... 42/51; 42/69.02

[58] Field of Search ..... 42/69.02, 51

[56] References Cited

U.S. PATENT DOCUMENTS

| | | | |
|---|---|---|---|
| 2,765,562 | 10/1956 | Roper et al. | 42/69.02 |
| 3,546,803 | 12/1970 | Swanson et al. | 42/69.02 |
| 3,755,947 | 9/1973 | Koon | 42/69.02 |
| 4,004,364 | 1/1977 | Chatigny | 42/69.02 |
| 4,065,866 | 1/1978 | Eguizabal | 42/51 |
| 4,215,502 | 8/1980 | Loven | 42/51 |
| 4,283,874 | 8/1981 | Vaughn | 42/51 |
| 4,437,249 | 3/1984 | Brown | 42/51 |
| 4,457,094 | 7/1984 | Thompson | 42/69.02 |
| 4,461,109 | 7/1984 | Eguizabal | 42/51 |
| 4,503,633 | 3/1985 | Davis | 42/51 |
| 4,519,156 | 5/1985 | Shaw | 42/51 |
| 4,669,211 | 6/1987 | Russell | 42/51 |
| 4,700,499 | 10/1987 | Knight | 42/51 |
| 4,715,139 | 12/1987 | Rodney | 42/51 |
| 4,888,901 | 12/1989 | French | 42/51 |
| 4,912,868 | 4/1990 | Thompson | 42/51 |
| 4,918,849 | 4/1990 | Spota | 42/51 |
| 5,133,143 | 7/1992 | Knight | 42/51 |

*Primary Examiner*—David H. Brown

*Attorney, Agent, or Firm*—Patnaude, Videbeck & Marsh

[57] ABSTRACT

A muzzle loading rifle has a cocking member which is rotatable about an axis perpendicular to the central axis of the barrel of the rifle and has a cam mounted on the distal end thereof. When the cocking member and the cam are rotated, the cam will move the hammer from a fired position to a cocked position. Second, a cylindrical primer holder having a transverse hole therethrough is provided to retain a primer charge. The primer holder may be rotated from a firing position to a safety position while retaining the charge enclosed within the receiver of the rifle. Third, a safety lever rotates about an axis perpendicular to the axis of rotation of the hammer sear from a first locked position to a second unlocked position. Movement of the safety lever to the second position unlocks the sear and allows the weapon to be fired.

15 Claims, 4 Drawing Sheets

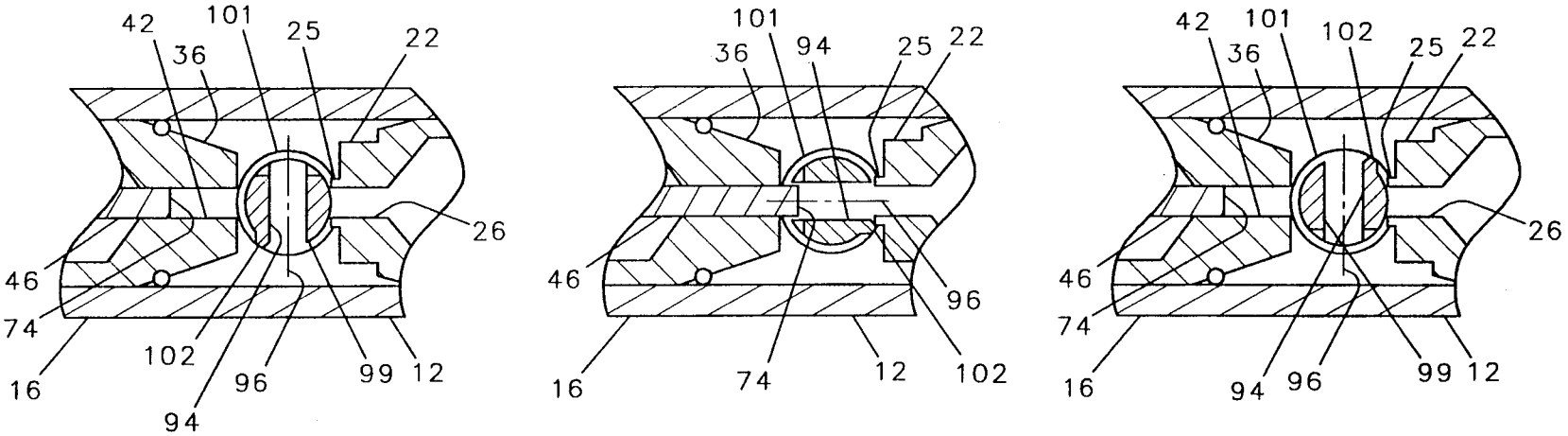
FIG. 3
FIG. 4
FIG. 5
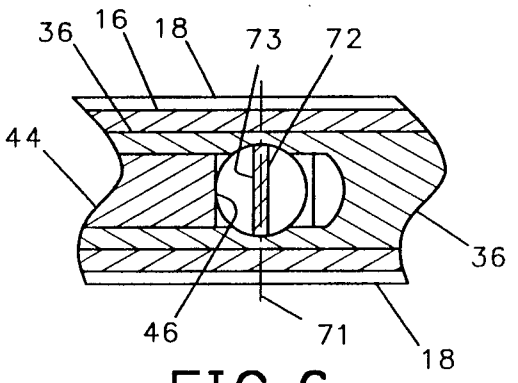
FIG. 6
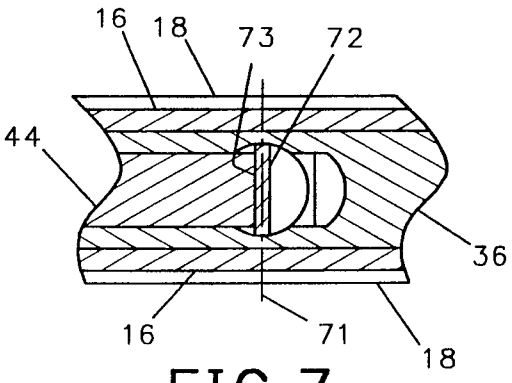
FIG. 7
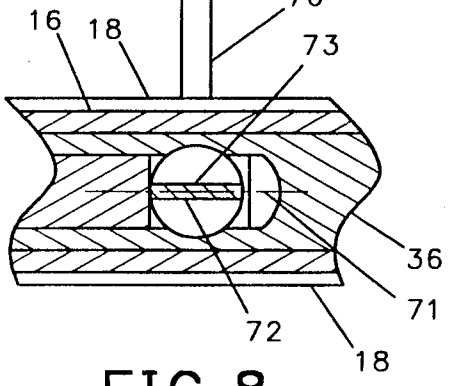
FIG. 8

MUZZLE LOADING RIFLES

The present invention generally relates to rifles, and in particular to muzzle loading rifles.

BACKGROUND OF THE INVENTION

Although the muzzle loading rifle is a weapon of the past, such weapons continue to be in use because the hunting laws of numerous states provide for longer hunting seasons for hunters using bows and arrows and muzzle loading rifles than for modern repeater rifles. As a result, it is desirable to provide a rifle which loads through the muzzle so as to comply with the applicable state hunting laws, but incorporates safety features, and can be easily and safely loaded, primed and cocked.

To fire such weapons, it is necessary that an ignition system be provided which responds to a hammer and ignites a charge of gun powder to propel a bullet from the weapon. The existing muzzle loading weapons have an external retainer upon which a firing cap is positioned and a bore extending from the retainer to the breach of the weapon. Gunpowder poured into the breach also fills the small bore leading to the cap retainer. A firing cap is then positioned in the retainer and is struck by the hammer when the weapon is fired. The firing cap of such weapons is exposed to the ambient, and may become damp or loosened as a result of movement of the weapon, such that the weapon is caused to misfire. It is therefore desirable to provide a muzzle loading weapon in which the ignition cap is fully enclosed during use so as to be protected from the ambient.

Furthermore, existing muzzle loading rifles have either an external hammer mechanism which is cocked by manually pulling the hammer back, or an internal axially slidable hammer which is cocked by pulling backward on an external end piece extending rearwardly from the receiver of the rifle. In either case, portions of the hammer mechanism are exposed and are subject to deterioration and may fail as a result of foreign material entering into the mechanism. It is therefore desirable to provide a muzzle loading weapon which has a fully enclosed hammer mechanism and incorporates suitable safety provisions to prevent spurious discharge of the weapon.

BRIEF DESCRIPTION OF THE INVENTION

Briefly, the present invention is embodied in a rifle having a tubular barrel and a tubular receiver positioned behind the barrel for retaining an axially movable hammer. A spring urges the hammer from a rearward cocked position to a forward fired position within the receiver.

One feature of the present invention is a cocking member which is moveable about an axis perpendicular to the central axis of the barrel of the rifle and having a cam mounted on the distal end thereof. The cam is positioned against a portion of the hammer when the hammer is in the fired position. When the cocking member and the cam are rotated, the cam will move the hammer from the fired position to a cocked position.

In another important feature of the present invention, an aperture is provided in the outer wall of the barrel forward of the receiver and behind the breach. A cylindrical primer holder having a transverse hole therethrough adapted to retain a primer charge has a diameter less than the diameter of the aperture in the barrel such that the primer holder may be extended into the barrel with an ignition charge fitted in the transverse hole. The ignition charges in the primer holder will be positioned adjacent and immediately forward of the hammer when it is in the fired position and adjacent and immediately behind the breach of the weapon. A small bore extends through the rearward end of the breach such that when the weapon is loaded, a flash or spark will travel through the small bore and ignite the charge. Alternately, the primer holder may be rotated within the aperture in the barrel to a safety position in which the axis of the transverse hole is perpendicular to the central longitudinal axis of the barrel. When in the rotated position, a charge fitted into the transverse hole of the primer holder cannot be stricken by the hammer and the rifle will not fire.

The present invention further provides for a hammer sear mounted for pivotal rotation about a central transverse axis and a pin on the sear positioned to retain the hammer in the cocked position when the sear is in a first position and for releasing the hammer when the sear is in a second position. A third important feature of the present invention is a pivotally mounted lever which moves about a central axis perpendicular to the axis of rotation of the sear. The safety lever is rotatable from a first position to a second position, and has means attached to one end of the lever for locking the sear in the first position when the safety lever is in the first position. Movement of the safety lever to the second position unlocks the sear and allows the weapon to be fired.

When the safety lever is an elongate member and extends adjacent the rear of the receiver, the safety lever will lock the sear when the handle end of the lever is centered along the length of the weapon and will unlock the sear when the lever is turned to one side of the rifle. When the locking mechanism is turned to one side, and the sear is thereby unlocked, the locking lever will extend to one side of the rifle and cause an obstruction rendering the rifle difficult to store or handle. A user will therefore be inclined to maintain the safety lever in the central, locked position, except for when the rifle is to be intentionally fired. Furthermore, the lever is readily visible on the rifle, and especially conspicuous when the lever is moved to a side firing position so as to alert not only the user, but others in the near proximity of the rifle that the safety lever is deactivated.

BRIEF DESCRIPTION OF THE DRAWINGS

A better understanding of the present invention can be had by a reading of the following detailed description of the invention taken in accompaniment with the drawings wherein:

FIG. 3 is an enlarged fragmentary cross-sectional view taken through line 3—3 of FIG. 1 showing a primer holder inserted into the rifle of FIG. 1 and rotated into the loading position;

FIG. 4 is an enlarged fragmentary cross-sectional view of a rifle in accordance with FIG. 1 similar to FIG. 3 in which the primer holder is rotated into the fired position;

FIG. 5 is an enlarged fragmentary cross-sectional view of the rifle in FIG. 1 also similar to FIG. 3 in which the primer holder is rotated into the safety position;

FIG. 6 is a fragmentary cross-sectional view taken through line 6—6 of FIG. 1 showing portions of the hammer, the cocking member, and the cam with the hammer in the cocked position;

FIG. 7 is another fragmentary cross-sectional view of the rifle shown in FIG. 1 taken through line 6—6 of FIG. 1 showing the hammer in the fired position;

FIG. 8 is another fragmentary cross-sectional view of the rifle in FIG. 1 but showing the cocking lever and cam in the cocking position.

DETAILED DESCRIPTION OF A PREFERRED EMBODIMENT

Figure 1:
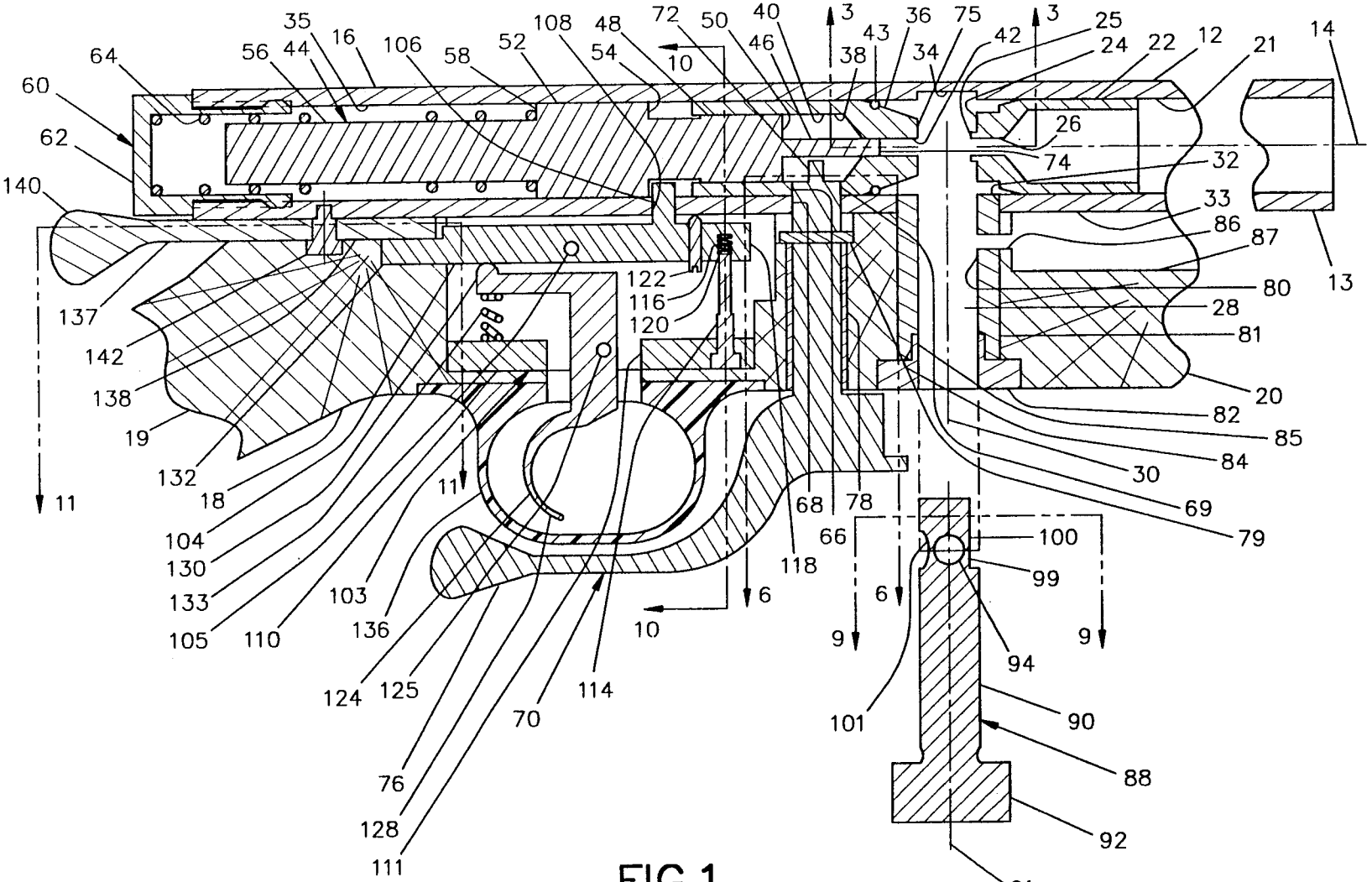
FIG. 1 is a fragmentary cross-sectional view of a rifle in accordance with the present invention showing a primer holder withdrawn from the rifle, the hammer in the cocked position and the safety lever in the locking position.

Referring to FIG. 1, a muzzle loading gun, which is usually a rifle 10, has a barrel 12 at one end of which is a muzzle 13 and adjacent the other end of which is a receiver 16 which may be integral with the barrel 12. The barrel 12 has a central longitudinal axis 14 and the barrel 12 and receiver 16 are attached to a stock 18 by any suitable means, such as screws threaded into the barrel (not shown). The rear end 19 of the stock is adapted to be fitted against the shoulder of a user, and the forward end 20 of the stock 18 is adapted to be grasped by one hand for holding the rifle during firing.

The barrel 12 has an internal bore 21 and fitted within the rear end of the bore 21 is a tubular breach plug 22 having a rear wall 24. Extending rearward from the rear wall 24 is a centrally located nipple 25, and extending through the rear wall 24 and through the nipple 25 is a narrow axial bore or flash hole 26.

As can be seen in FIG. 1, the outer surface of the rear wall 24 of the breach plug 22 defines part of the walls of a downwardly extending passageway 28 having an axis 30 perpendicular to the central longitudinal axis 14 of the bore 12 which extends into the barrel 12 through a circular aperture 32 in the lower wall 33 of the barrel 12. The passageway 28 extends downwardly through the forward end 20 of the stock 18. Diametrically opposed to and above the aperture 32 is a blind bore 34 in the upper inner surface of the bore 21.

Immediately behind the passageway 28 is the tubular receiver 16 which has a central bore 35 co-axial with the central longitudinal axis of the bore 21 of the barrel 12. At the forward end of the bore 35 of the receiver 16 is a tubular hammer sleeve 36 having a bore 38 extending axially therethrough. The rearward portion 40 of the bore 38 has a relatively large diameter and the forward portion 42 of the bore 38 has a relatively narrow diameter. An 0-ring 43 fitted around the hammer sleeve 36 and within the bore 21 prevents gas from the discharge of the rifle 10 from entering the receiver 16.

Positioned within the receiver 16 is a cylindrical hammer 44 having a cylindrical striking end 46. The diameter of the striking end 46 is a little smaller than the diameter of the forward portion 42 of the axial bore 38 in the hammer sleeve 36 so as to slideably fit therein. Rearward of the striking portion 46, the hammer 44 has a second, larger cylindrical portion 48, defining an annular shoulder 50 between the striking portion 46 and the larger portion 48. The second cylindrical portion 48 is sized to fit slideably with the rearward portion 40 of the bore 38. Rearward of the second cylindrical portion 48 is a third cylindrical portion 52 sized to fit slideably within the bore 35 of the receiver 16, and between the second and third cylindrical portions 48, 52, respectively, is a second shoulder 54. Rearward of the third cylindrical portion 52 of the hammer 44 is a fourth smaller cylindrical portion 56 and between the third and fourth cylindrical portions 52, 56, respectively, is a third rearwardly facing annular shoulder 58.

Threaded into the distal end of the receiver 16 is a tubular cap 60 having a transverse end wall 62. A spring 64 is compressed between the end wall 62 of the tubular cap 60 and the rearwardly facing third annular shoulder 58 of the hammer 44 and is biased so as to urge the hammer 44 towards the muzzle 14 of the rifle 10. The fourth cylindrical portion 56 of the hammer 44 is adapted to fit slideably within the coils of the spring 64.

Figure 2:
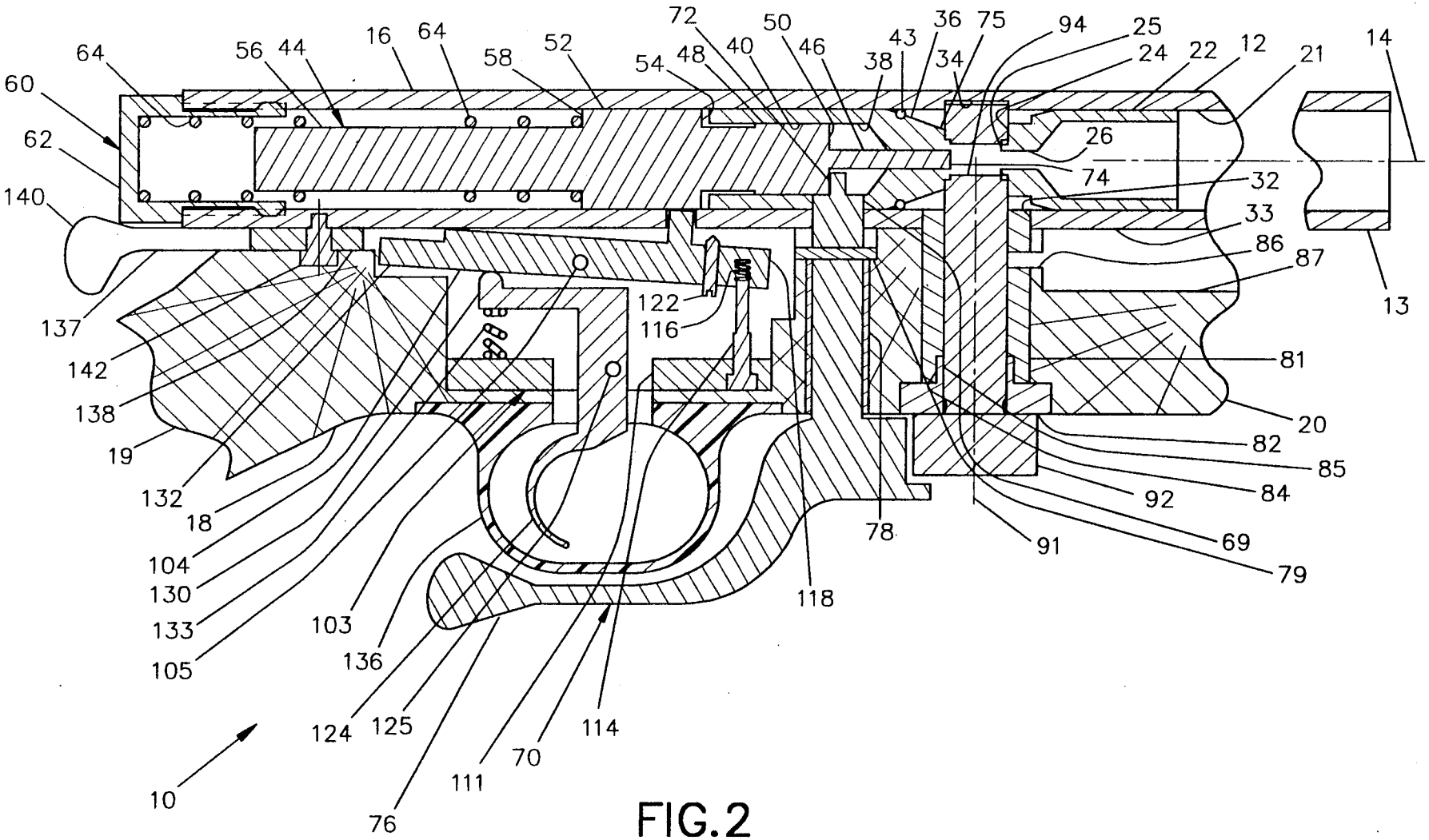
FIG. 2 is a fragmentary cross-sectional view of the rifle in FIG. 1 showing the hammer in the fired position, the primer holder in the firing position, and the safety lever in the unlocked position.

An aperture 66 in the rearward portion 40 of the hammer sleeve 36 is aligned with a complementary aperture 68 in the receiver 16 to receive the distal end 69 of a cylindrical cocking member 70. The distal end 69 of the cocking member 70 extends into the rearward portion 40 of the axial bore 38 of the hammer sleeve 36. As best shown in FIG. 6, 7 and 8, a cam 72 in the form of a longitudinal rib having an axis 71 extends across the distal end 69 of the cocking member 00. The cocking member 70 and rib 72 are inserted into the apertures 66 and 68 upwardly into the rearward portion 40 of the bore 38 of the hammer sleeve 36 and the rib 72 is positioned so as to engage the first shoulder 50, but not interfere with the striking portion 46 of the hammer 44. The striking portion 46 of the hammer 44 is sufficiently long such that when the axis 71 of the cam 72 is transverse to the axis 14 of the barrel 12 and the first shoulder 50 of the hammer 44 abuts the side 73 of the cam 72 as shown in FIGS. 2 and 7. The distal end 74 of the striking portion 46 of the hammer 44 will extend a short distance beyond the distal end 75 of the hammer sleeve 36. When the hammer 44 is positioned with the annular shoulder 50 abutting the side 73 of the cam 72 as shown in FIG. 7, and the distal end 74 of the striking portion 46 extending from the distal end 75 of the hammer sleeve 36, as shown in FIG. 2, the hammer 44 is in the fired position.

A handle 76 is provided at the lower end of the cylindrical cocking member 70 such that the user may use his fingers to rotate the cocking member 70 and the cam 72 at the distal end 69 thereof will exert force against the shoulder 50 of the hammer 44 and cause the hammer 44 to move backwards and compress the spring 64. As shown in FIG. 8, when the cocking handle 76 is rotated, the hammer 44 will be moved sufficiently rearward within the receive 16 so as to be retained in a cocked position shown in FIG. 1 and as hereinafter described. The cocking member 70 is rotatably fitted within a sleeve 78 and retained therein by a transverse pin 79.

The passageway 28 extends downward below the barrel 12 through the forward end 20 of the stock 18 and is defined by the inner bore 80 of a cylindrical sleeve 81 affixed to the barrel 12. A stock nut 82 having external threads 84 threadedly engages complementary threads 85 in an enlarged portion of the bore 80 in the sleeve 81 to define the lower end of the passageway 28. An orifice 86 in the sleeve 81 permits gasses discharged through the narrow bore 26 in the breach plug 22 to be released into a cavity 87 in the stock 18 for retaining a ram rod, not shown.

As shown in FIG. 1 and FIG. 2, a removable primer holder 88 has an elongate cylindrical body 90 having an axis 91 and at the lower end thereof an enlarged cylindrical head 92 adapted to be grasped and turned with the human hand. The diameter of the body 90 is adapted to fit slideably within the bore 80 in the sleeve 81 defining the passageway 28. A transverse bore 94 having an axis 96 perpendicular to the axis of the cylindrical body 90 of the primer holder 88 is positioned near the upper first end 98 thereof. The transverse bore 94 is adapted to receive a suitable primer charge, such as a number 209 shot shell primer, or a large rifle primer, or a number 11 percussion cap. As shown in FIG. 2, the body 90 of the primer holder 88 has a length such that when the primer holder 88 is positioned within the cylindrical passageway 28 with the head 92 abutting the stock nut 82, the body 90 of the primer holder 88 will extend through the sleeve 81, and the aperture 32 in the barrel 12 and the first end 98 thereof will fit within the blind bore 34 in the barrel 12.

As shown in FIGS. 2 and 4 when the primer holder 88 is rotated such that the axis 96 of the transverse bore 94 is parallel to the central longitudinal axis 14 of the barrel 12 a primer charge fitted within the transverse bore 94 will be positioned between the hammer sleeve 36 and the rear wall 24 of the breach plug 22 and will be aligned with the forward portion 42 of the axial bore 38 in the hammer sleeve 36 on one side and on the other side with the small bore 26 in the rear wall 24 of the breach plug 22. When the primer holder 88 is positioned as shown in FIGS. 2 and 4, a charge fitted therein will be struck by the striking portion 46 of the hammer 44 when the hammer 44 moves from the cocked position shown in FIG. 1 to the fired position shown in FIG. 2. When the hammer 44 thus moves from the cocked position to the fired position, a charge within the transverse bore 94 will be exploded and will flash through the small bore 26 of the rear wall 24 of the breach plug 22 and ignite the charge therein.

Figure 9:
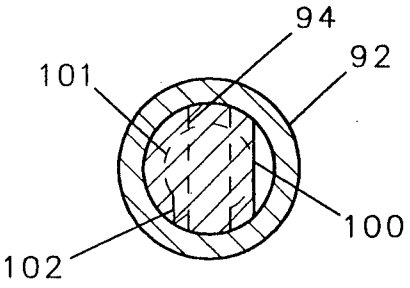
FIG. 9 is a cross-sectional view of a primer holder in accordance with the present invention taken through line 9—9 of FIG. 1.

Referring to FIG. 9, the upper end section 99 of the primer holder 88 has a flat 100 having a plane parallel to the axis 96 of the bore 94 and parallel to the axis 91 of the primer holder 88 to permit insertion of the primer holder into the passageway 28 without interfering with the nipple 25. As shown in FIG. 1, the nipple 25 of the breach plug 22 extends rearwardly into the passageway 28. When the primer holder 88 is fitted into the passageway 28, the nipple 25 will prevent the further insertion of the first end 98 thereof unless the flat 100 is turned toward the nipple 25 as shown in FIGS. 1 and 3. A groove 101 shown in phantom lines in FIG. 9 and in cross-section in FIGS. 3, 4 and 5 extends around a portion of the circumferences of the primer holder 88 in a plane parallel with transverse bore 94 and is sized so as to receive the nipple 25 therein and permit rotation of the primer holder 88 when it is fully inserted into the passageway 28 as shown in FIG. 2. A stop 102 in the groove 101 prevents rotation of the primer holder 88 through a full 360 degrees and assisting in aligning and adjusting of the primer holder into the firing and safety positions shown in FIGS. 4 and 5, respectively.

When the primer holder 88 is rotated until the axis 96 of the transverse bore 94 is perpendicular to the central longitudinal axis 14 of the barrel 12 as shown in FIG. 5, a primer charge fitted into the transverse hole 94 will not be struck by the hammer when it moves from the cocked position to the fired position. The rotation of the primer holder to the position shown in FIG. 5 is therefor a safety position whereby the rifle 10 cannot be fired.

Figure 10:
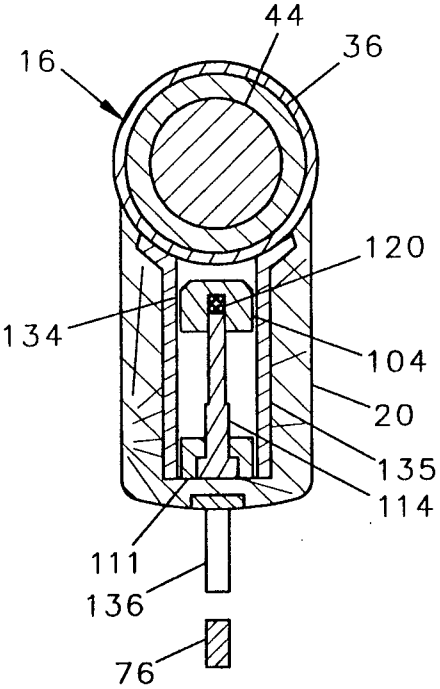
FIG. 10 is a fragmentary cross-sectional view of the rifle shown in FIG. 1 taken through line 10—10 of FIG. 1.

Referring further to FIG. 1, the rifle 10 further includes a trigger mechanism 103 having an elongate hammer sear 104 pivotally mounted on a centrally located transverse axis 105 and at the forward end of the hammer sear 104 is a pin 106. The pin 106 is adapted to extend through an aperture 108 in the receiver 16, and when the hammer 44 is in the cocked position, as shown in FIG. 1, the second shoulder 54 is adapted to be in a position adjacent the aperture 108 such that the hammer 44 can be retained in the cocked position by the pin 106 extending through the aperture 108 and abutting the second shoulder 54. The trigger mechanism 103 includes first and second lower end pieces 110 and 111, respectively, and as shown in FIG. 10, extending through the second lower end piece 111 is a first trigger adjustment screw 114 which extends slideably into a blind bore 116 in the distal end 118 of the hammer sear 104. A spring 120 positioned between the distal end of the first trigger adjustment screw 114 and the end surface of the blind bore 116 urges the distal end 118 of the hammer sear 102 upward and the pin 106 through the aperture 108 in the receiver 16.

A second hammer adjustment screw 122 threadedly extending through the hammer sear 104 and will abut against the undersurface of the receiver 16 when the pin 106 extends through the aperture 108. The second adjustment screw 122 provides adjustment of the length of the pin 106 which extends through the aperture 108. The first and second trigger adjustment screws 114, 122, respectively, will adjust the pressure required to pull the trigger and fire the rifle.

A trigger 124 pivotally mounted on a pin 125 has a lower finger grip 128 and an upper lever arm 130. The distal end 131 of the upper lever arm 130 is held against the rear end 132 of the hammer sear 104 by a spring 133 positioned between the lever arm 130 and the first lower end piece 110. As can be seen, a rearward pull on the finger grip 128 of the trigger 124 will exert an upward pressure on the rear end 132 of the hammer sear 104 and cause the pin 106 to be withdrawn from the aperture 108 and thereby allow the hammer 44 to be moved axially toward the muzzle 13 of the rifle 10 and causes it to fire as previously described. The trigger assembly 103 including the first and second lower end pieces 110 and 111, respectively, and the pins 105, 106 for the trigger 124 and hammer sear 104, respectively, are held in assembled relationship by side members 134, 135. Also, a trigger guard 136 protects the finger grip 128 from being inadvertently moved.

Figure 11:
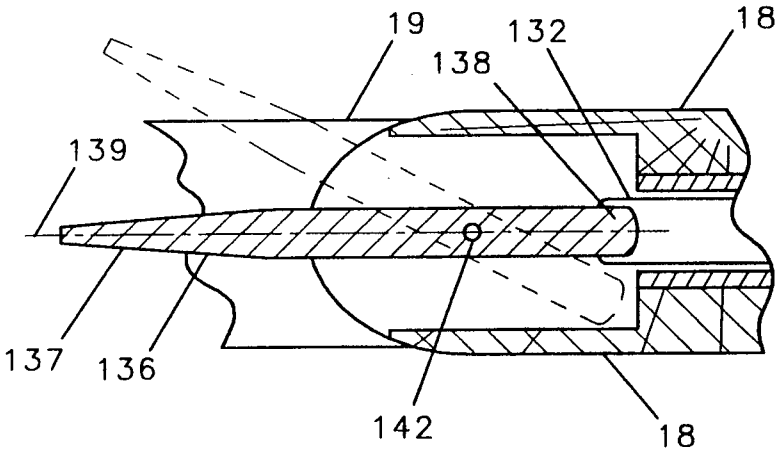
FIG. 11 is a fragmentary cross-sectional view of the rifle in FIG. 1 taken through line 11—11 of FIG. 1.

As can be seen in FIG. 1, when the hammer 44 is in the cocked position, and the pin 106 extends through the aperture 108, there is a space between the rear end 132 of the hammer sear and the bottom of the receiver 16. As shown in FIG. 2, when the finger grip 128 of the trigger 124 is pulled, the rear end 132 of the hammer sear 104 moves upward. Referring to FIGS. 1, 2 and 11, there is provided in accordance with the present invention a safety lever 137 having an inner end and an outer handle 140 pivots about a centrally located pivot pin 142 which is threaded into a complementary threaded bore in the lower rear end of the receiver 16.

The safety lever 136 is made of a suitable metallic material and its outer end is a handle 140 and its inner end is a movable spacer 138. As can best be seen in FIG. 11, when the longitudinal axis 139 of the lever arm 136 is positioned parallel to the central longitudinal axis 14 of the barrel 12, the spacer 138 is positioned between the rear end 132 of the hammer sear 104 and the bottom portion of the receiver 16 thereby preventing the hammer sear 104 from rotating upward about the pin 104 and preventing the rifle 10 from being fired. In order to fire the rifle 10, the handle 140 of the safety lever 136 must be moved either to the left or the right of the axis 14 of the barrel 12 of the rifle 10 as is shown in phantom lines in FIG. 11 such that the spacer 138 will no longer be between the rear end 132 of the sear 102 and the bottom of the receiver 16. The sear 102 is then permitted to rotate around the pin 104 such that the rifle 10 can be fired.

It should be apparent that the rifle 10 is most easily stored with a minimum of interference from the parts thereof when the safety lever 136 is in the center position. A user of the rifle 10 will be inclined to maintain the safety lever 136 in the central position at all times except when the rifle 10 is to be fired. Furthermore, the safety lever 136 can be seen at a substantial distance from the rifle 10 such that not only a user but anyone in the near proximity of the rifle 10 can readily recognize whether the safety lever 136 is deactivated.

There has therefore been disclosed a muzzle loading rifle 10 having a fully enclosed hammer 44 which can be moved to a cocked position by the rotation of an exterior cocking member 70. Furthermore, there is disclosed a primer holder 88 which retains a primer charge in a sealed position within the rifle 10 and which can be turned from a load position to a firing position or to a safety position. Finally, there is also disclosed a second safety lever 136 to protect against spurious firing of the rifle 10.

While the present invention has been described in connection with one embodiment, it will be apparent to those skilled in the art that many modifications and changes thereto may be made without departing from the true spirit and scope of the invention. Therefore, it is intended by the appended claims to cover all such changes and modifications which come within the true spirit and scope of the present invention.

What is claimed is:

1. A gun comprising in combination
a tubular barrel having an outer wall and an inner axial bore,
said barrel further having two ends, one of said ends adjacent a tubular receiver and another of said ends having a muzzle,
a hammer axially movable within said receiver and said hammer having a fired position within said receiver,
said manner further having a forward end extending toward said muzzle,
spring means for urging said hammer toward said muzzle,
said outer wall of said barrel having an aperture therein opening into said bore adjacent said receiver,
a primer holder having a first end,
means for retaining a primer on said first end of said primer holder,
said primer holder slidable through said aperture and means for retaining said primer holder within said aperture and said first end adjacent said forward end of said hammer when said hammer is in said fired position.

2. A gun in accordance with claim 1 wherein said means for retaining a primer comprises:
a transverse hole through said first end thereof for retaining a primer therein.

3. A gun in accordance with claim 1 further comprising:
said primer holder being rotatable within said aperture form a first firing position to a second safety position.

4. A gun in accordance with claim 1 further comprising:
said hammer also having a cocked position within said receiver,
said spring means urging said hammer from said cocked position toward said fired position, and
cam means for moving said hammer from said fired position to said cocked position.

5. A gun in accordance with claim 4 further comprising:
a hammer sear having two ends,
said hammer sear mounted for pivotal rotation about a transverse axis and pivotable from a first position to a second position,
said hammer sear having pin means for retaining said hammer in said cocked position when said hammer sear is in said first position and for releasing said hammer from said cocked position when said hammer is in said second position,
a safety lever and mounted for rotation about a transverse axis from a locked position to an unlocked position, and
locking means on said safety lever for releaseably locking one of said ends of said hammer sear in said first position.

6. A gun in accordance with claim 5 wherein said means for retaining a primer comprises:
a transverse hole through said first end thereof for retaining a primer therein.

7. A gun in accordance with claim 6 further comprising,
a cocking member mounted for rotation about an axis perpendicular to a central axis of said receiver, and
said cam means mounted on said cocking member.

8. A gun in accordance with claim 7 wherein said locking means further comprises a movable spacer, said spacer being positioned between said one of said ends of said hammer sear and an outer surface of said receiver when said safety lever is in said locked position.

9. A gun comprising in combination
a tubular barrel having a tubular receiver at one end thereof,
said receiver having an our surface,
a hammer axially movable within said receiver from a cocked position to a fired position,
spring means for urging said hammer from said cocked position to said fired position,
a hammer sear having two ends,
said hammer sear mounted for pivotal rotation about a transverse axis and pivotable from a first position to a second position,
means for retaining said hammer in said cocked position when said hammer sear is in said first position and means for releasing said hammer from said cocked position when said hammer sear is moved to said second position, a safety lever mounted for rotation about a transverse axis from a locked position to an unlocked position, and locking means on said safety lever for releasably locking one of said ends of said hammer sear in said first position.

10. A gun in accordance with claim 9, wherein said locking means further comprises a movable spacer, said spacer being positioned between said one of said ends of said hammer sear and said outer surface of said receiver when said safety lever is in said locked position.

11. A gun in accordance with claim 9 wherein said transverse axis of said safety lever is perpendicular to said transverse axis of said hammer sear.

12. A gun in accordance with claim 11 wherein said locking member further comprises a movable spacer, said spacer being positioned between said one of said ends of said hammer sear and said outer surface of said receiver when said safety lever is in said locked position.

13. A gun comprising in combination:

a receiver having an outer wall and an axial bore, a hammer axially movable within said receiver from a first cocked position to a second fired position, spring means for urging said hammer from said cocked position to said fired position, and cam means for moving said hammer from said fired position to said cocked position, and said cam means rotatable about an axis perpendicular to a central axis of said receiver.

14. A gun in accordance with claim 13 further comprising:

cocking means operably connected to said cam means for rotating said cam means, said cocking means being rotatable outside of a plane defined by said central axis of said receiver and said axis of said cam means.

15. A gun comprising in combination:

a receiver having an outer wall and an axial bore, a hammer axially movable within said receiver from a first cocked position to a second fired position, spring means for urging said hammer from said cocked position to said fired position, cam means for moving said hammer from said fired position to said cocked position, a cocking member mounted for rotation about an axis perpendicular to a central axis of said receiver, and said cam means mounted on said cocking member.

* * * * *